United States Patent [19]

Rieger

[11] Patent Number: 4,924,850

[45] Date of Patent: May 15, 1990

[54] METHOD AND ADAPTOR FOR INSTALLING FLUE LINER TO A FIREPLACE INSERT

[76] Inventor: Heinz H. Rieger, 17 Martin Road, Toronto, Canada, M4S 2V1

[21] Appl. No.: 237,067

[22] Filed: Aug. 29, 1988

[51] Int. Cl.[5] ..... F24C 15/30

[52] U.S. Cl. ..... 126/500; 126/315

[58] Field of Search ..... 110/317; 126/500, 314, 126/315, 318

[56] References Cited

U.S. PATENT DOCUMENTS

| | | | |
|---|---|---|---|
| 4,495,933 | 1/1985 | Schinbeckler | 126/500 |
| 4,596,232 | 6/1986 | Dowding | 126/500 |
| 4,700,687 | 10/1987 | Bailey et al. | 126/500 |
| 4,766,882 | 8/1988 | Schinbeckler | 126/315 |

*Primary Examiner*—Edward G. Favors

*Attorney, Agent, or Firm*—David W. Wong

[57] ABSTRACT

A method and adaptor for installing a flue liner in a fireplace chimney in the installation of a fireplace insert is shown. The adaptor can be slidably mounted on top of the firebox of the fireplace insert with two slider brackets mounted on top of the firebox. The adaptor has a sleeve therein for coupling to the flue liner. The flue liner can be conveniently installed by first inserting it into the chimney with its lower end connected to the sleeve. The adaptor is then slidably mounted to the firebox by slidably engaging with the two slider brackets while the firebox is being inset into the fireplace.

6 Claims, 2 Drawing Sheets

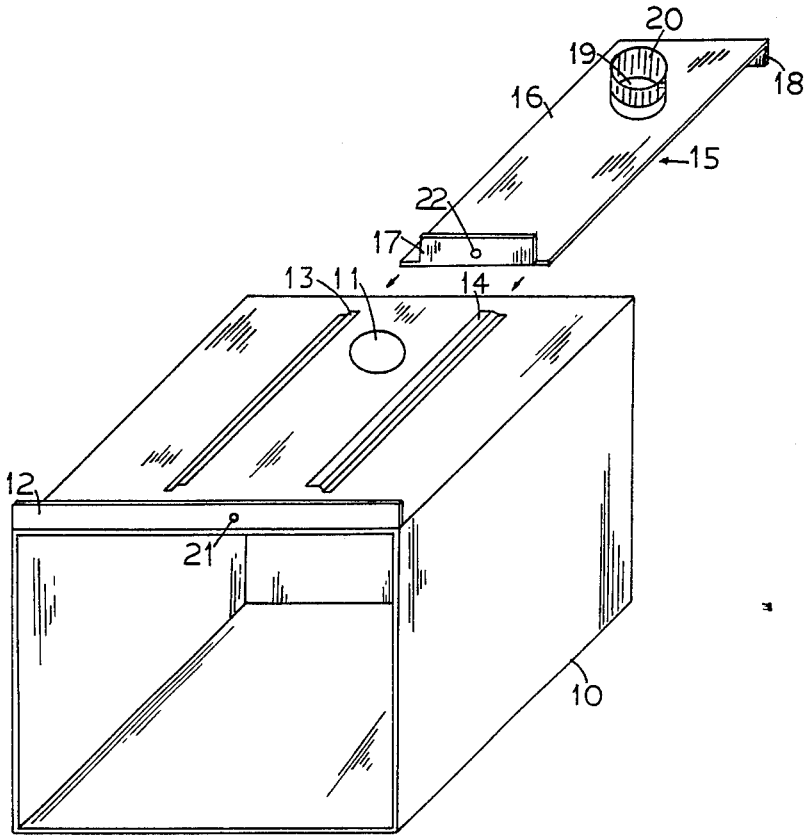
FIG. 1
FIG. 2
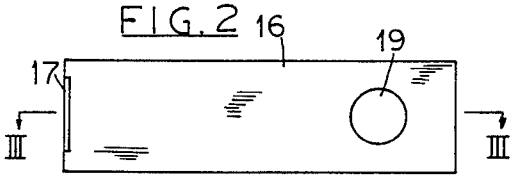
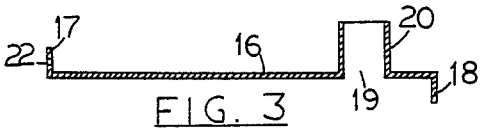
FIG. 3

METHOD AND ADAPTOR FOR INSTALLING FLUE LINER TO A FIREPLACE INSERT

BACKGROUND OF THE INVENTION

This invention relates to fireplace inserts and particularly to a method and an adaptor for installing a flue liner to the fireplace chimney and to the firebox of the fireplace insert.

In the installation of fireplace insert a flue liner or duct must be provided for the firebox to conduct the exhaust from the firebox of the insert to the chimney of the fireplace. Commonly, an exhaust opening is formed at the top panel of the firebox which will be located below the chimney opening when the firebox is fully inset into the fireplace. A flue liner or duct is installed on the exhaust opening of the firebox and is pushed upwards into the fireplace chimney to ensure that the exhaust gas is directed entirely up into the chimney so that no exhaust gas can leak into the space between the firebox and the fireplace. Such leakage of exhaust gas would return to the room to present a human health hazard. It has been problematic in the installation of the flue liner to the fireplace insert firebox in that there is an extremely little space between the firebox and the fireplace walls once the firebox is inset into the fireplace. Thus it is extremely difficult to maneuver the flue liner into the chimney or to connect it properly to the exhaust opening of the firebox of the fireplace insert.

SUMMARY OF THE INVENTION

It is an object of the present invention to provide a method of installing the flue liner precisely in the fire place chimney as well as to the firebox exhaust opening.

It is another object of the present invention to provide an adaptor for the fireplace insert which facilitates the flue liner installation.

DESCRIPTION OF THE DRAWINGS

Other objects of this invention will appear in the following description and appended claims, reference being made to the accompanying drawings forming a part of the specification wherein like reference numerals designate corresponding parts in the several views.

FIG. 1 is a perspective elevation view of a firebox having a flue liner adaptor according to the present invention.

FIG. 2 is a perspective to elevation view of the flue liner adaptor according to the present invention.

FIG. 3 is a side elevation view of the flue liner adaptor.

DETAILED DESCRIPTION OF THE INVENTION

Figure 4:
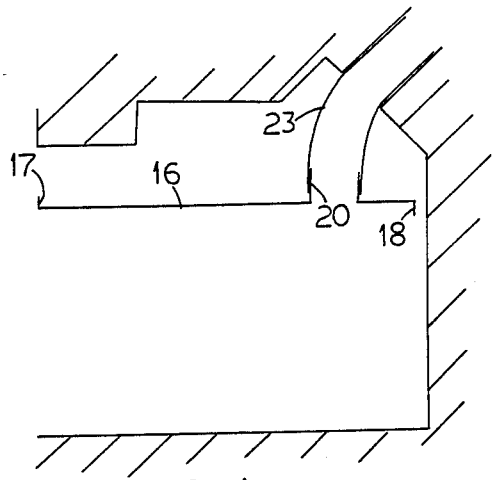
FIG. 4 through 6 are side schematic elevation views illustrating the method according to the present invention of installing the flue liner to the chimney as well as to the firebox in a fireplace.

Referring to the drawings, the fireplace insert is composed of a firebox 10 having an exhaust opening 11 formed at its top panel. An upstanding flange 12 is provided at the upper front edge of the firebox 10. Two mutually parallel slider brackets 13 and 14 are provided on the top of the firebox 10. The slider brackets 13 and 14 preferably extend throughout the entire longitudinal length of the firebox top panel from the front to the rear. However, it can be appreciated shorter brackets or a plurality of short brackets may be provided to obtain similar function which will become more apparent from the following description.

A flue adaptor 15 may be mounted to the top of the firebox 10 by slidably engaging with the slider brackets 13 and 14. The flue adaptor 15 consists of a slider plate 16 which has a width equal to the spacing between the channels of the slider brackets 13 and 14 and has a length equal to the firebox 10. An upstanding front flange 17 is provided at the front edge of the slider plate 16. The length of the upstanding front flange 17 is slightly less than the distance between the opposing lateral edges of the slider brackets 13 and 14 such that the ends of the flange 17 are recessed from the lateral edges of the slider plate 16. A downwardly extending skirting flange 18 is provided at the rear edge of the slider plate 16. A coupling opening 19 is formed in the slider plate 16 and a short coupling sleeve 20 is provided at the coupling opening 19 and extending upwardly therefrom. The flue adaptor 15 may be mounted to the top of the firebox 10 by slidably engaging the edge portions of the adaptor plate 16 with the channels formed between the slider brackets 13 and 14 and the top of the firebox 10. In the fully mounted position, the front flange 17 abuts the upstanding flange 12 at the upper front edge of the firebox 10, meanwhile the rear flange 18 abuts the rear panel of the firebox 10, also the coupling opening 19 of the adaptor becomes aligned with the exhaust opening 11 at the top of the firebox 10. The flue adaptor 15 can be secured to the firebox 10 by using a bolt or screw engaging opening 21 formed in the firebox front flange 12 and the opening 22 formed in the front flange 17 of the adaptor 15.

Figure 5:
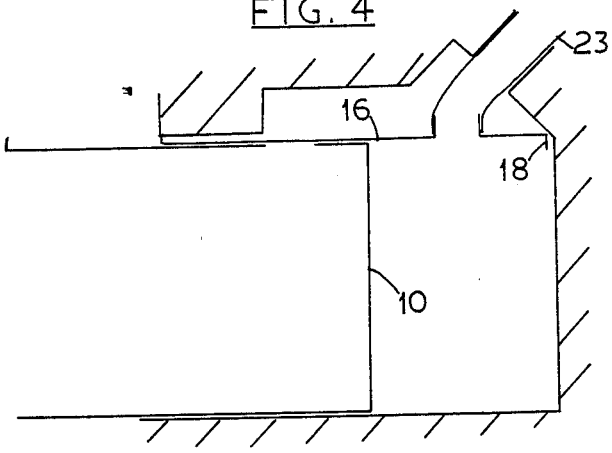
Figure 6:
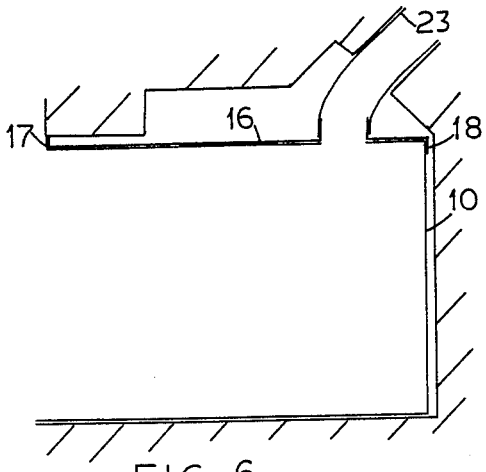

As shown in FIGS. 4 through 6, in installing the firebox 10 into the fireplace, the flue liner or duct 23 is first simply pushed upwards into the fireplace chimney. This can be easily achieved since the empty fireplace provides open free access to the chimney. The flue liner 23 may be a metal duct shaped in predetermined angle for easy engagement with the fireplace chimney or a flexible type metal duct may be used. The bottom end of the flue liner 23 is then secured to the coupling sleeve 20 of the flue adaptor 15 in a well known manner. The firebox 10 may then be pushed into the fireplace with the flue adaptor 15 inherently slidably engaging with the slider brackets 13 and 14. When the firebox 10 is fully inset in the fireplace the front flange 17 of the flue adaptor 15 will abut the upstanding flange 12 at the upper front edge of the firebox while the skirting flange 18 will abut the rear panel of the firebox. The flue adaptor 15 may then be secured to the upstanding flange 12 of the firebox 10 with at least one screw or bolt. The slider brackets 13 and 14 in combination with the intimate engagement of the flanges 12 and 17 and the skirting flange with the rear panel of the firebox 10 formed a tight enclosure to prevent the exhaust gas from the firebox 10 from leaking through the joints between the firebox 10 and the adaptor 15.

Accordingly, the present invention has been described with some degree of particularity directed to the preferred embodiment of the present invention. It should be appreciated, though, that the present invention is defined by the claims construed in light of the prior art so that modifications or changes may be made to the preferred embodiment of the present invention without departing from the inventive concepts contained herein.

I claim:

1. A method of installing flue liner in a fireplace chimney for a fireplace insert firebox wherein said firebox having an exhaust opening formed in a top panel therein, comprising, mounting at least two slider bracket means on said top panel of said firebox, inserting a flue liner means slidably upwards into said chimney with a free lower end of said flue liner extending below said chimney, connecting said lower end of said flue liner to a sleeve means mounted on a plate member of an adaptor means having an opening formed in said plate member in an area bounded by said sleeve means, said plate member being slidably engageable with said slider bracket means, slidably mounting said plate member of said adaptor means onto said slider bracket means while insetting said firebox into said fireplace until said exhaust opening of said firebox aligning with said opening in said plate member.

2. A method of installing flue liner according to claim 1 wherein said adaptor means is secured to said firebox with a securing means adapted at an upstanding front flange of said firebox and a second front flange located at a front end of said adaptor means.

3. In a firebox suitable for installation in a fireplace having a chimney , said firebox having an exhaust opening formed in a top panel therein a flue liner adaptor means comprising, at least two slider bracket means operative for mounting on said top panel of said firebox, a plate means operative slidably engageable with said slider bracket means mounted on said firebox, said plate means having a coupling opening formed therein, a sleeve means located over said coupling opening and extending upwardly from said plate means, and operative for connection with a flue liner inserted into said chimney.

4. A flue liner adaptor means according to claim 3 wherein said slider bracket means are two mutually parallel and spaced slider bracket members mounted on said top panel of said firebox, and said coupling opening of said plate means being aligned with said exhaust opening when said plate means is fully and slidably mounted on said top panel of said firebox.

5. A flue liner adaptor means according to claim 4 wherein said plate means includes a front flange extending upwardly from a front end therein, and said front flange having a maximum length equal to the distance between said slider bracket means.

6. A flue liner adaptor means according to claim 5 wherein said plate means includes a skirting flange extending downwardly form a rear end therein, said skirting flange being operative to abut a rear panel of said firebox when said plate means is fully mounted on said top panel of said firebox.

* * * * *